United States Patent [19]

Uhtenwoldt et al.

[11] 4,112,624

[45] Sep. 12, 1978

[54] GRINDING MACHINE

[75] Inventors: Herbert R. Uhtenwoldt; Norman S. Humes, both of Worcester, Mass.

[73] Assignee: Cincinnati Milacron-Heald Corp., Worcester, Mass.

[21] Appl. No.: 816,268

[22] Filed: Jul. 18, 1977

Related U.S. Application Data

[63] Continuation of Ser. No. 651,434, Jan. 22, 1976, abandoned.

[51] Int. Cl.[2] ..... B24B 53/14

[52] U.S. Cl. ..... 51/5 D; 51/73 R; 51/236; 125/11 CD

[58] Field of Search ..... 51/73 R, 236 R, 237 R, 51/5 D; 125/11 CD, 11 R

[56] References Cited

U.S. PATENT DOCUMENTS

| | | | |
|---|---|---|---|
| 2,723,499 | 11/1955 | Dix | 51/48 R |
| 2,784,534 | 3/1957 | Townsend | 51/237 R |
| 2,801,502 | 8/1957 | Blood | 51/48 R |
| 3,736,704 | 6/1973 | Robillard | 51/165.87 |

FOREIGN PATENT DOCUMENTS

| | | | |
|---|---|---|---|
| 1,125,805 | 3/1962 | Fed. Rep. of Germany | 125/11 CD |
| 194,581 | 5/1967 | U.S.S.R. | 125/11 CD |

*Primary Examiner*—Harold D. Whitehead
*Attorney, Agent, or Firm*—Norman S. Blodgett; Gerry A. Blodgett

[57] ABSTRACT

Grinding machine having annular dressing wheel whose inner surface is used for dressing.

12 Claims, 9 Drawing Figures

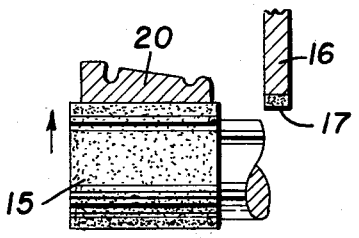
GRIND FIG.4
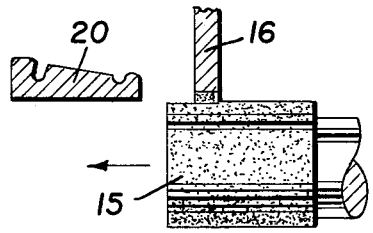
DRESS ON WAY IN FIG.8
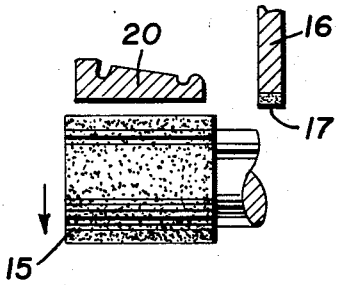
RETRACT FIG.5
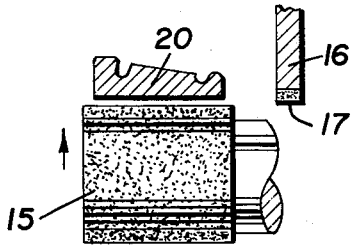
START FEED FIG.9
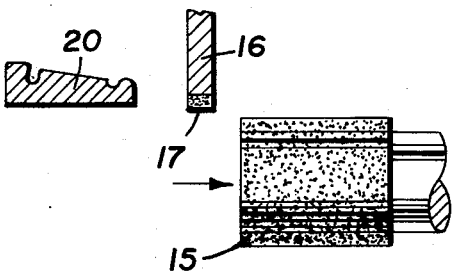
RUNOUT FIG.6
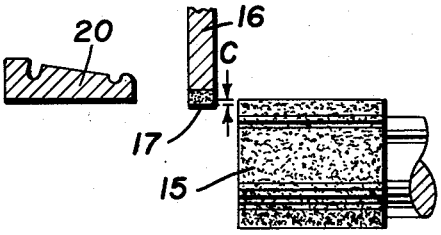
COMPENSATE FIG.7

GRINDING MACHINE

This is a continuation of application Ser. No. 651,434, filed Jan. 22, 1976, and now abandoned.

BACKGROUND OF THE INVENTION

In an internal grinding machine, it is common practice to provide for the occasional dressing of the abrasive wheel. Usually, this dressing operation involves the removal of a small layer of the material from the surface of the wheel to expose new abrasive particles. This is because (even in a diamond wheel) the cutting particles that protrude from the matrix become worn and the wheel becomes dull. Not only does such dullness produce a slower cutting cycle, but it produces forces on the wheel and on the spindle that distort the geometry of the finished surface. The usual method of dressing is to use either (1) a single point dresser, such as a large diamond that is passed axially along the cylindrical abrasive wheel and actually cuts the wheel and removes approximately 0.001 inch from its surface, or (2) a rotary dresser consisting of a cylinder similar in shape to the grinding wheel itself formed with a matrix in which large particles of diamond have been embedded. What this means is that the rotary dressing wheel is simply made of a harder substance than the abrasive wheel (which is also rotating) and, while each wheel removes a certain amount of material from the other, the dressing wheel removes more material from the abrasive wheel than vice versa. The fact that the abrasive wheel must be traversed longitudinally across the diamond means that a substantial part of the time used in the grinding cycle is consumed in this unproductive dressing procedure. Furthermore, the wear on a single-point diamond dresser produces a "drift" in the size of the finished workpiece. The complex mechanism necessary to support the rotary-type dresser also introduces inaccuracies as well as considerable cost. These and other difficulties experienced with the prior art devices have been obviated in a novel manner by the present invention.

It is, therefore, an outstanding object of the invention to provide a grinding machine having a dresser which is capable of being mounted very close to the work area so that the run-out of the abrasive wheel for dressing is short.

Another object of the present invention is the provision of an internal grinding machine having a dressing mechanism which is simple in construction and inexpensive to manufacture.

A further object of the present invention is the provision of an internal grinding machine having a dresser which is firmly mounted, so that it does not introduce inaccruracies to the surface of the abrasive wheel during dressing due to moving of its mount.

It is another object of the instant invention to provide a dressing mechanism for an internal grinding machine which can be readily adapted to use on an older machine for replacement purposes.

A still further object of the invention is the provision of an internal grinding machine with a dressing mechanism which is subject to very little wear and involves no complex mechanisms.

Another object of the present invention is the provision of an automatic grinding machine having a dresser capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a grinding machine having a base on which a wheelhead is mounted, the wheelhead having a rotatable spindle on which an abrasive wheel is mounted. A dressing mechanism is provided consisting of a dressing wheel in the form of an annulus located in a plane extending generally transversely of the spindle axis. The inner surface of the annulus has a diameter substantially larger than the external diameter of the abrasive wheel. Cycle means is provided for producing relative movement between the wheelhead and the dressing mechanism to bring about engagement between the said inner surface of the dressing wheel and the said external surface of the abrasive wheel to dress the latter.

More specifically, the cycle means serves to move the abrasive wheel relative to the workpiece and the dressing wheel, so that a dressing portion of the grinding cycle consists of a retraction movement, a run-out movement, a compensation movement, and a run-in movement during which the abrasive wheel engages the dressing wheel for a dress. An annular clamping plate engages one end of the workpiece and the clamping plate has a circular aperture through which the abrasive wheel advances axially during parts of the grinding cycle. The annular dressing wheel is mounted on the workpiece clamp generally concentric with the aperture with its inner portion protruding into the aperture.

BRIEF DESCRIPTION OF THE DRAWINGS

The character of the invention, however, may be best understood by reference to one of its structural forms, as illustrated by the accompanying drawings, in which:

FIGS. 4–9 are schematic views of certain parts of the machine at various stages of the grinding cycle.

DESCRIPTION OF THE PREFERRED EMBODIMENT

Figure 1:
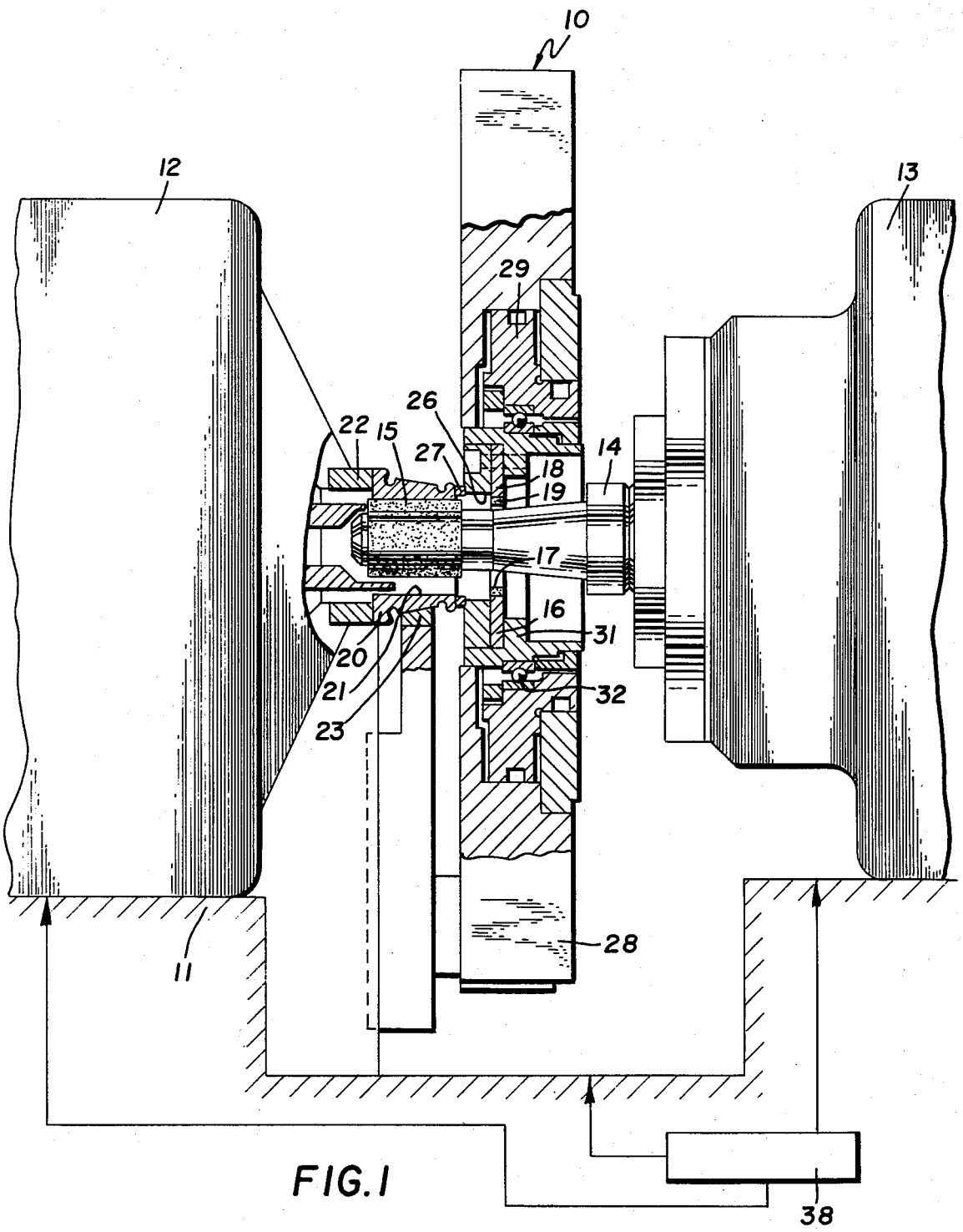
FIG. 1 is a vertical sectional view of a grinding machine embodying the principles of the present invention.

Referring first to FIG. 1, wherein are best shown the general features of the invention, the grinding machine, indicated generally by the reference numeral 10, is shown as having a base 11 on which is mounted a workhead 12 and a wheelhead 13. The wheelhead has a rotatable spindle 14 on which is mounted a cylindrical abrasive wheel 15. A dressing wheel 16 is provided in the form of an annulus located in a plane extending generally transversely of the axis of the spindle 14. The annular dressing wheel has an inner surface 17 whose diameter is substantially larger than the external diameter of the abrasive wheel 15. The usual cycle means associated with the base 11 is provided for producing relative movement between the wheelhead and the dressing wheel 16 to bring about dressing engagement between the said inner surface 17 of the dressing wheel and the said external surface of the abrasive wheel.

The grinding machine 10 is of the type shown and described in the patent of Robillard et al U.S. Pat. No. 3,503,158 which issued Mar. 31, 1970. As such, the cycle means is provided (and indicated schematically in FIG. 1 by the reference numeral 38) to cause longitudinal and transverse relative movement between the workhead 12 and the wheelhead 13 in the well-known manner.

The dressing wheel 16 is in the form of a metal ring 18 on the inner surface of which is mounted an abrasive ring 19. As is evident in the drawing, the spindle 14 is mounted in the wheelhead 13 in cantilever fashion for internal grinding and the abrasive ring 19 is in the form of a matrix in which diamonds are embedded.

The cycling means 38 serves to move the abrasive wheel 15 relative to a workpiece 20, so that a dressing portion of the grinding cycle consists of a retraction movement, a run-out movement, a compensation movement, and a run-in movement during which the abrasive wheel 15 engages the abrasive ring 19 for a dress.

In the preferred embodiment the workpiece 20 is of tubular form and is shown as the inner race of a roller bearing having a bore 21. The workhead 12 includes an annular magnetic platen 22 which engages the radial surface at one end of the workpiece. Suitable shoes 23 and 24 (see FIG. 2) engage the outer surface of the workpiece. An annular clamping plate 27 engages the radial surface at the other end of the workpiece in the well-known manner. The clamping plate 27 has a circular aperture 26 through which the abrasive wheel 15 advances axially during parts of the grinding cycle.

The annular dressing wheel 16 is mounted on the workpiece clamp 31 with its inner portion (and the abrasive ring 19) protruding into the aperture 26. The clamping plate 27 has a hardened metal annular nose that is concentric with the aperture 26 and which extends axially of the plate for engagement with the end of the workpiece. The dressing wheel 16 is located close to this nose. The clamping plate 27 is constructed so that it can be moved axially away from the workpiece for loading and unloading and then, by the introduction of pressure air, can be moved into clamping position against the new workpiece. The clamping plate consists of two relatively moving parts, i.e., a relatively fixed main body 28 and a piston portion 29 (which is slideable axially in a large bore formed in the main body 28). It moves under pneumatic pressure which can be supplied on occasion in the well-known manner. Finally, the workpiece clamp 31 is mounted inside the piston 29 by means of a ball bearing 32, so that it can rotate with the workpiece which is driven by the platen 22. The workpiece clamp 31 carries the dressing wheel 16 and the hardened metal nose 27.

Figure 2:
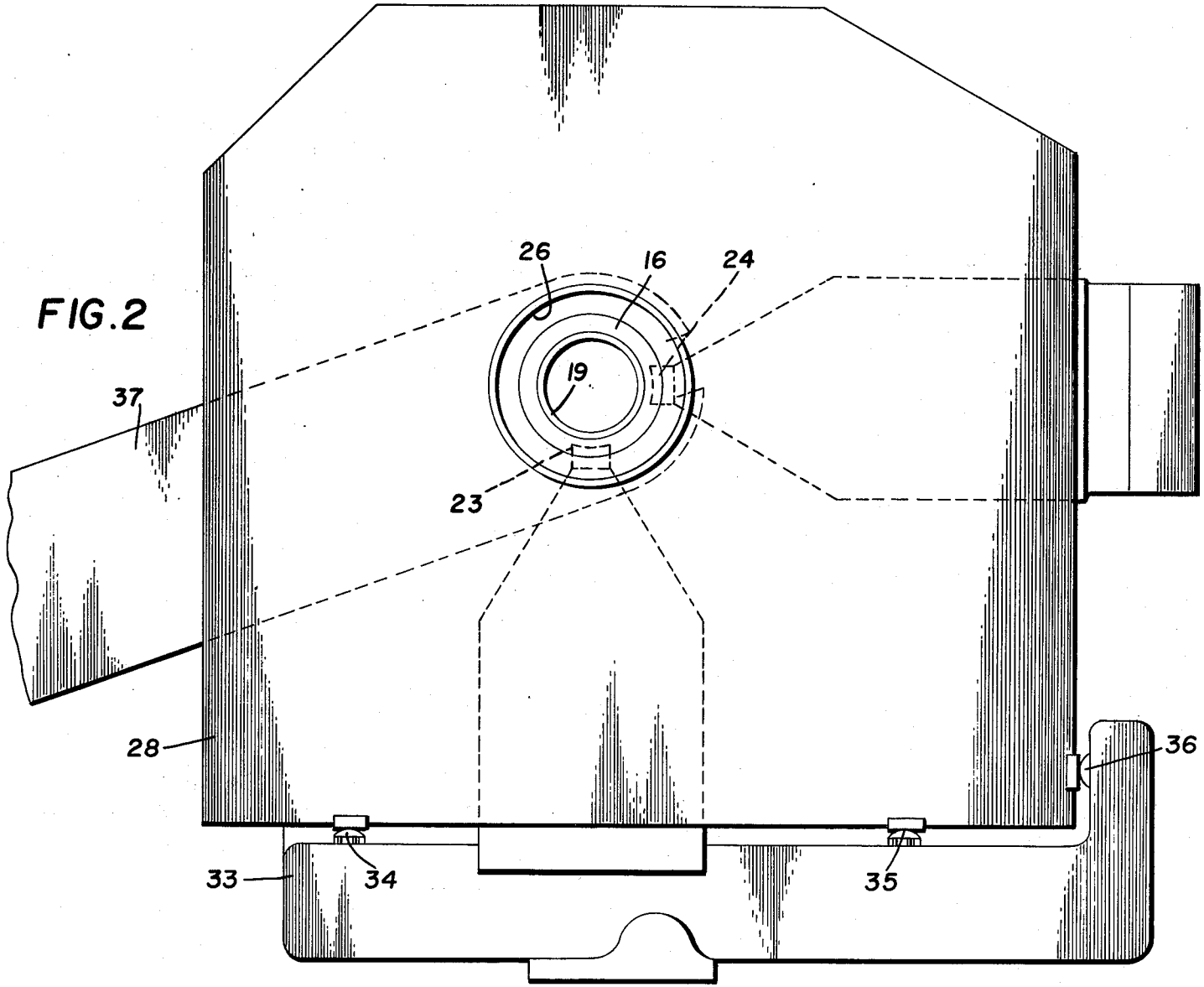
FIG. 2 is a right-hand end elevational view of the machine.

In FIG. 2 it can be seen that the main body 28 of the workpiece clamp is carried in a frame 33 which (in the preferred embodiment) is mounted on the outer end of the workhead 12 or the table on which the workhead 12 is mounted. The body 23 is supported on two adjustable screws 34 and 35 which carry a substantial portion of its weight; its transverse position relative to the axis of the spindle 14 is determined by another adjustable screw 36. A loading arm 37 is pivotally mounted for introducing new workpieces and removing finished workpieces. In this figure of the drawing, one can observe through the aperture 26 the presence of the dressing wheel 16 with the diamond ring 19.

Figure 3:
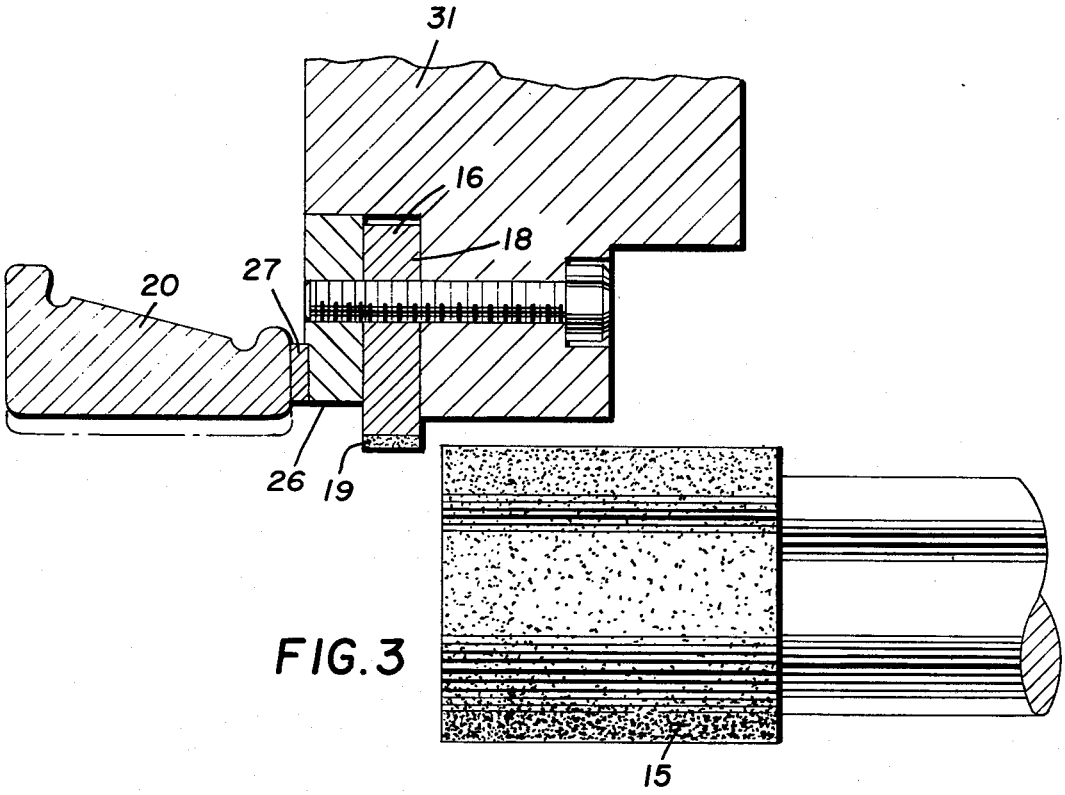
FIG. 3 is a somewhat schematic view of the operative parts of the machine showing the manner in which they operate.

FIG. 3 shows the relative relationship between important parts of the invention, including the workpiece 20, the abrasive wheel 15, and the clamping plate 27 as well as the dressing wheel 16 with its metal ring 18 and the diamond ring 19.

FIGS. 4–9 show the manner in which a dressing portion of the grinding cycle is carried out under instructions from the cycle means 38. In FIG. 4 the abrasive wheel is shown grinding the bore in the workpiece 20. At a certain portion of the grinding cycle, indicated usually by a gage which reads the size of the bore, the wheel 15 is retracted transversely of the machine to the point shown in FIG. 5, where the outer surface of the abrasive wheel 15 is substantially spaced toward the axis from the surface of the bore of the workpiece 20; it also resides a considerable distance from the dressing surface 17 of the dressing wheel 16. As shown in FIG. 6, the wheel 15 is then carried axially outwardly on a run-out motion until it passes outwardly of the plane of the dressing wheel 16. In FIG. 7 it can be seen that the wheel is subjected to a transverse compensating movement until the surface of the wheel resides outwardly of the surface 17 of the dressing wheel by a short distance indicated by the letter "C." In FIG. 8 the wheel 15 is moved axially toward the workpiece and the dressing wheel 16 is shown removing a portion of the surface of the abrasive wheel to expose new abrasive particles. Finally, in FIG. 9 the wheel has passed completely over the dressing wheel 16 and is then coextensive with the bore in the workpiece 20; at this time the wheel starts to feed toward the workpiece to perform a finish grinding operation.

The advantages of the present invention can now be readily seen from the above description. Since the dressing wheel 16 rotates with the workpiece clamp 31 of the clamping plate, various parts of its surface are constantly being exposed to contact with the abrasive wheel. As a matter of fact, if dressing takes place (as is normally the case) while the workpiece is still clamped in place, the dressing wheel rotates relative to the abrasive wheel 15 while the abrasive wheel is being moved axially in the manner shown in FIG. 8. This means that very little of the surface of the dressing wheel is exposed to the dressing operation at a given time and the diamond points that take part in the dressing operation are constantly being replaced by others. It should be noted that, although the abrasive wheel 15 is driven from the wheelhead motor and the dressing ring 16 is driven from the plate 22 and they are rotated in the same direction, the dressing ring moves at a substantially lower surface speed than the abrasive wheel. Furthermore, even though theoretical "line" contact exists between the cylindrical surface of the abrasive wheel 15 and the cylindrical surface 17 of the dressing wheel 16, nevertheless, as a practical matter, the dressing wheel of the present invention wraps around the wheel and provides a secure, broad dressing surface, thus operating statistically to provide a very accurate surface. Furthermore, as can be seen in FIG. 3, the fact that it is only necessary to run-out (FIG. 6) and run-in (FIG. 8) a short distance, means that the entire grinding cycle can be shortened. This is particularly important, since the dressing portion of the cycle is non-productive, i.e., does not involve removing metal from the workpiece. This advantage results from the nature of the dressing wheel; since it is fairly thin, it can be mounted very close to the workpiece 20. The larger area of contact due to the wrap-around, as compared with the use of a single-point diamond or a convex dressing wheel, means that dressing scratches or cuts average out to produce a much more accurately-formed abrasive wheel surface, which means that the bore in the workpiece is also more accurately formed.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Grinding machine for finishing a bore in a tubular workpiece, comprising:
(a) a base,
(b) a wheelhead mounted on the base and having a rotatable spindle with an abrasive wheel,
(c) a workhead mounted on the base, said workhead including an annular platen which rotates and engages one end of the workpiece, and including shoes which engage the outer surface of the workpiece,
(d) an annular workpiece clamp mounted on the base for rotation about an axis parallel to the axis of said workpiece bore and which engages the other end of the workpiece, the workpiece clamp having a circular aperture through which the abrasive wheel advances axially during parts of the grinding cycle,
(e) a dressing wheel in the form of an annulus mounted on the workpiece clamp with its inner dressing surface protruding into the aperture and located in a general plane extending transversely of the spindle axis, the inner dressing surface of the annulus having a diameter substantially larger than the external diameter of the abrasive wheel, the dressing wheel being mounted for rotation with the clamp about the major axis of the annulus, and
(f) means producing relative movement between the wheelhead and the dressing wheel to bring about dressing engagement between the said inner surface of the dressing wheel and the said external surface of the abrasive wheel.

2. Grinding machine as recited in claim 1, wherein the dressing wheel is in the form of a metal ring on the inner surface of which is mounted an abrasive ring.

3. Grinding machine as recited in claim 2, wherein the spindle is mounted in the wheelhead in cantilevered fashion for internal grinding, and wherein the abrasive ring is in the form of a matrix in which diamonds are embedded.

4. Grinding machine as recited in claim 3, wherein the means serves to move the abrasive wheel relative to the workpiece, so that a dressing portion of the grinding cycle consists of a retraction movement, a run-out movement, a compensation movement, and a run-in movement during which the abrasive wheel engages the abrasive ring for dressing the wheel.

5. Grinding machine as recited in claim 1, wherein the workpiece clamp has a hardened metal annular nose that is concentric with the aperture and extends axially of the plate for engagement with the end of the workpiece, the dressing wheel being located close to the nose.

6. Grinding machine as recited in claim 1, wherein the plane of the dressing wheel is close to the said other end of the workpiece, so that the dressing cycle is short.

7. Grinding machine for finishing a bore in a tubular workpiece, comprising:
(a) a base,
(b) a wheelhead mounted on the base and having a rotatable spindle with an abrasive wheel,
(c) a workhead mounted on the base, said workhead including means which engages to workpiece and rotates it and including shoes which engage the outer surface of the workpiece,
(d) a support body fixedly mounted on the base, the support body having a circular aperture through which the abrasive wheel advances axially during parts of the grinding cycle,
(e) a dressing wheel in the form of a rigid annulus mounted on the support body with its inner dressing surface protruding into the aperture and located in a general plane extending transversely of the spindle axis, the inner dressing surface of the annulus having a diameter substantially larger than the external diameter of the abrasive wheel, the dressing wheel being mounted in bearings in the support body aperture for rotation independently of the wheelhead about the major axis of the annulus, and
(f) feed means producing relative movement between the wheelhead and the dressing wheel to bring about dressing engagement between the said inner surface of the dressing wheel and the said external surface of the abrasive wheel.

8. Grinding machine as recited in claim 7, wherein the dressing wheel is in the form of a metal ring on the inner surface of which is mounted an abrasive ring.

9. Grinding machine as recited in claim 8, wherein the spindle is mounted in the wheelhead in cantilevered fashion for internal grinding, and wherein the abrasive ring is in the form of a matrix in which diamonds are embedded.

10. Grinding machine as recited in claim 9, wherein the feed means serves to move the abrasive wheel relative to the workpiece, so that a dressing portion of the grinding cycle consists of a retraction movement, a run-out movement, a compensation movement, and a run-in movement during which the abrasive wheel engages the abrasive ring for dressing the wheel.

11. Grinding machine as recited in claim 7, wherein the support body is also provided with a workpiece clamp has a hardened metal annular nose that is concentric with the aperture and extends axially of the plate for engagement with the outer end of the workpiece, the dressing wheel being located close to the nose.

12. Grinding machine as recited in claim 7, wherein the plane of the dressing wheel is close to the said outer end of the workpiece, so that the dressing cycle is short.

* * * * *